US007823574B2

(12) United States Patent
Chu

(10) Patent No.: US 7,823,574 B2
(45) Date of Patent: Nov. 2, 2010

(54) BALL-THROWING MACHINE

(75) Inventor: Hsiao Hsi Chu, Taiping (TW)

(73) Assignee: Xpider Co., Ltd., Taichung Hsien (TW)

( * ) Notice: Subject to any disclaimer, the term of this patent is extended or adjusted under 35 U.S.C. 154(b) by 503 days.

(21) Appl. No.: 11/938,278

(22) Filed: Nov. 10, 2007

(65) Prior Publication Data

US 2009/0120421 A1 May 14, 2009

(51) Int. Cl.
*F41B 4/00* (2006.01)

(52) U.S. Cl. ..... 124/78; 124/6

(58) Field of Classification Search ..... 124/6, 124/78

See application file for complete search history.

(56) References Cited

U.S. PATENT DOCUMENTS 5,125,653 A * 6/1992 Kovacs et al. ..... 124/78
5,464,208 A * 11/1995 Pierce ..... 473/451
5,490,493 A * 2/1996 Salansky ..... 124/78
2006/0137672 A1 6/2006 Smith

* cited by examiner

*Primary Examiner*—John Ricci
(74) *Attorney, Agent, or Firm*—Ming Chow; Sinorica, LLC

(57) ABSTRACT

A ball-throwing machine includes a frame and a ball-throwing mechanism pivotally connected with the frame. The ball-throwing machine further includes a circuit unit. Via a first servomotor and a first linkage, the circuit unit serves to move the ball-throwing mechanism to a ball-throwing angle and drive the ball-throwing mechanism to continuously swing up and down. The frame can be pivotally mounted on a base. Via a second motor and a second linkage, the circuit unit serves to drive the frame to horizontally swing back and forth. In addition, the ball-throwing machine has a safety switch. When setting the functions of the ball-throwing machine, a user can press the safety switch to stop the operation of ball throwing so as to protect a person from being incautiously hit and injured. The circuit unit further has a malfunction detection function for detecting whether the ball-throwing machine works normally.

20 Claims, 14 Drawing Sheets

BALL-THROWING MACHINE

FIELD OF THE INVENTION

The present invention is related to a ball sport equipment, and more particularly to a ball-throwing machine.

BACKGROUND OF THE INVENTION

A ball-throwing machine serves to help a player in exercising a ball sport. A kind of conventional ball-throwing machine employs resilient force, for example, provided by leaf springs, to bound out a ball. Another kind of conventional ball-throwing machine includes two throwing wheels rotatable in reverse directions. Via the rotational energy of the throwing wheels, the ball is thrown out of the ball-throwing machine. The throwing wheels can be tilted to change the angle of the thrown ball.

US Publication No. 2006/0137672 discloses an oscillating ball throwing machine, which includes a yoke assembly having two ball-throwing wheels. A first linkage is connected with the yoke assembly and drivable by a first motor. A second linkage and a cam are connected with the yoke assembly and drivable by a second motor. The first linkage can be driven by the first motor to move the yoke assembly to a nominal ball-throwing angle. The second linkage and the cam can be driven by the second motor to periodically oscillate the yoke assembly within an angle range two-degree plus and minus the nominal angle. Accordingly, the ball can be thrown out within a four-degree range so that the path and destination of the ball can be changed.

In Publication No. 2006/0137672, for controlling and changing the angle of the thrown ball, two motors, two linkages and one cam are needed to drive the yoke assembly.

Moreover, when setting function of a conventional ball-throwing machine, the ball-throwing operation still goes on. Under such circumstance, the ball is likely to hit a user and make the user injured.

SUMMARY OF THE INVENTION

It is therefore a primary object of the present invention to provide a ball-throwing machine including a frame and a ball-throwing mechanism pivotally connected with the frame. Via only a motor and a linkage, the ball-throwing machine moves the ball-throwing mechanism to a ball-throwing angle and drives the ball-throwing mechanism to continuously swing up and down (vertically) to adjust and vary the ball-throwing angle.

It is a further object of the present invention to provide the above ball-throwing machine which further includes a circuit unit and an angle sensor. The circuit unit serves to move the ball-throwing mechanism to a necessary ball-throwing angle and drive the ball-throwing mechanism to continuously swing up and down so as to vary the destination of the thrown ball.

It is still a further object of the present invention to provide a ball-throwing machine including a second motor and a second linkage for driving the frame to swing horizontally (left and right).

It is still a further object of the present invention to provide the above ball-throwing machine which further includes a second angle sensor for controlling the horizontal swinging angle of the ball-throwing machine.

It is still an object of the present invention to provide a ball-throwing machine in which the ball-throwing operation can be stopped without cutting off the main power when setting the functions of the ball-throwing machine so as to provide a safety and protect a person from being incautiously hit and injured.

It is still an object of the present invention to provide a ball-throwing machine which has a malfunction detection function for detecting whether the ball-throwing machine works normally.

The present invention can be best understood through the following description and accompanying drawings wherein:

DETAILED DESCRIPTION OF THE PREFERRED EMBODIMENTS

Figure 1:
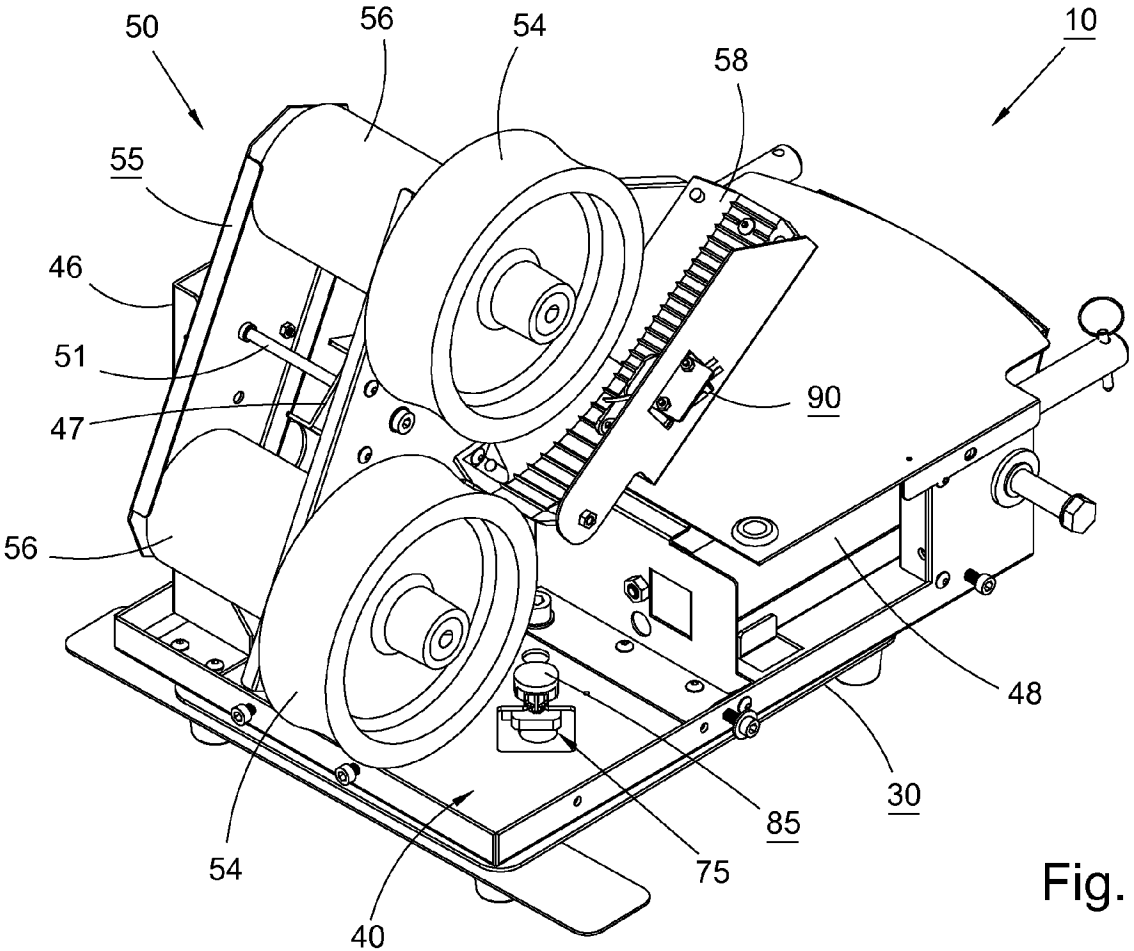
FIG. 1 is a right perspective view of a preferred embodiment of the present invention.
Figure 2:
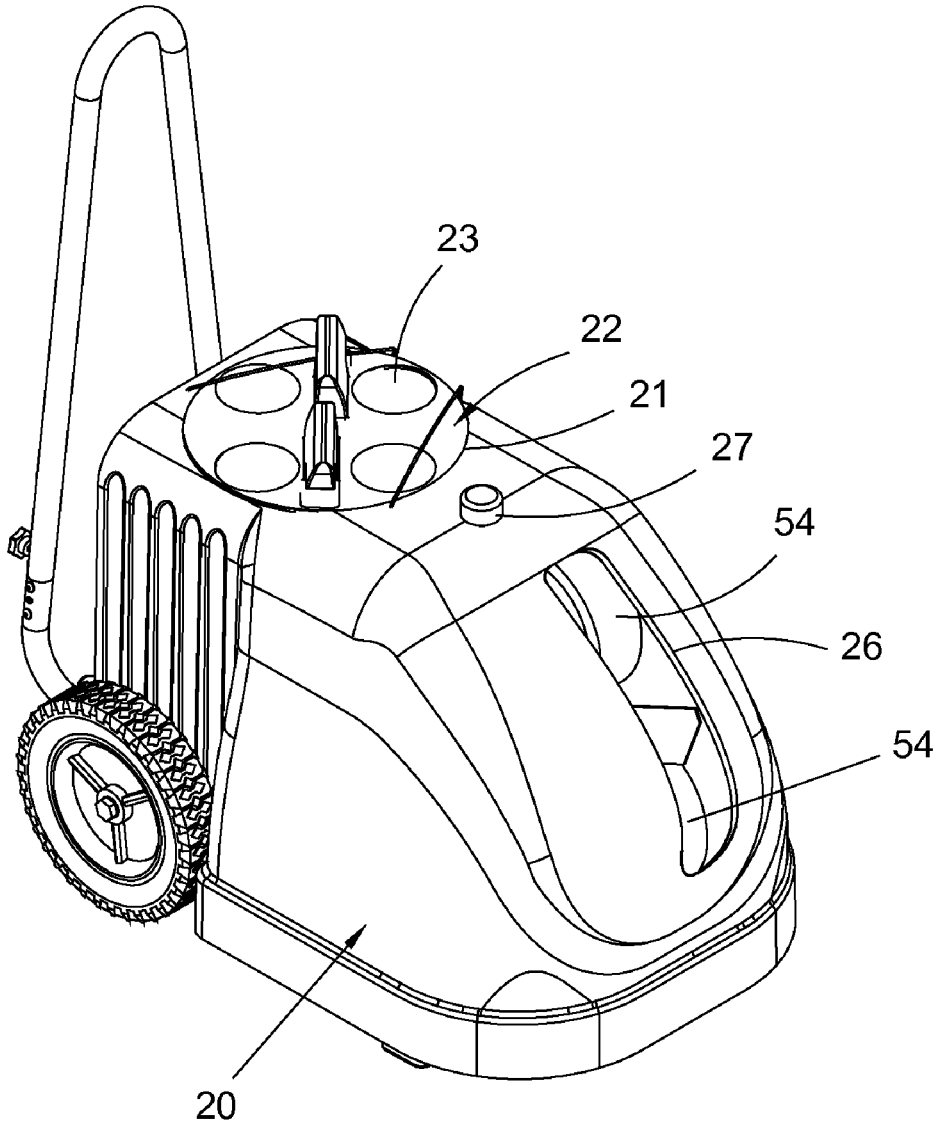
FIG. 2 is a perspective view showing that the embodiment of FIG. 1 is installed in a housing.

Please refer to FIGS. 1 and 2. According to a preferred embodiment, the ball-throwing machine 10 of the present invention is mounted in a housing 20. Also referring to FIG. 3, a rotary tray 22 of a ball-feeding mechanism is pivotally connected in a dent 21 of a top face of the housing 20 and is drivable by a motor 24. The rotary tray 22 is formed with several holes 23 for accommodating tennis balls therein. When one of the holes 23 of the rotary tray 22 is aligned with a hole 25 on a bottom wall of the dent 21, the ball drops from the hole 25 into the housing 20. Accordingly, the ball is fed into the ball-throwing machine 10 for throwing the ball. The ball goes out of the ball-throwing machine 10 from an opening 26 of a front face of the housing 20. The rotary tray 22 pertains to prior art and will not be further described hereinafter. At least one chucking boss 27 is disposed on a top face of the housing. A ball basket (not shown) can be latched with the chucking boss 27 and located on the top face of the housing. A bottom wall of the ball basket has a through hole aligned with the rotary tray 22. A plurality of tennis balls can be placed in the ball basket to drop into the holes 23 of the rotary tray 22.

Figure 5:
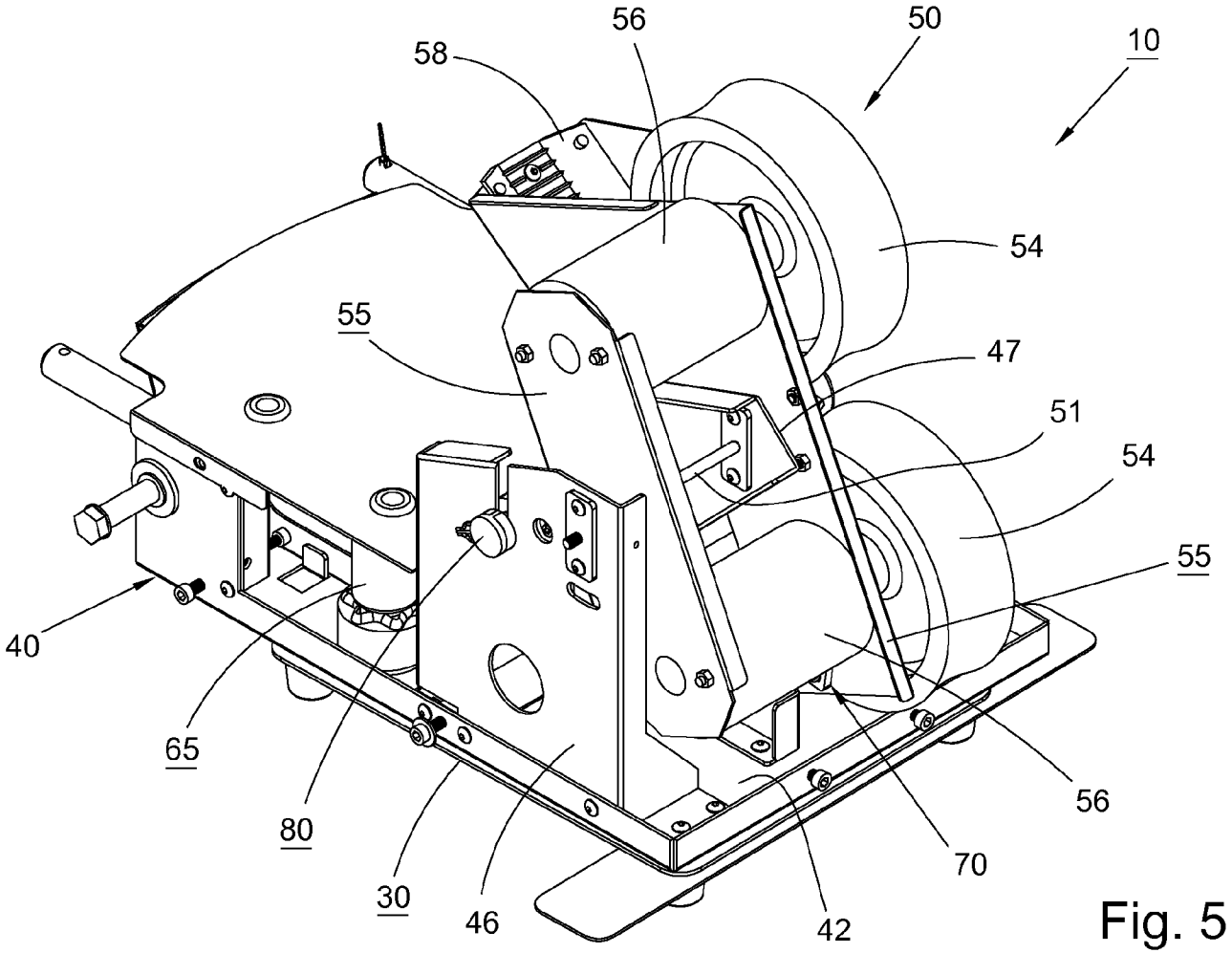
FIG. 5 is a left perspective view of the preferred embodiment of the present invention.
Figure 6:
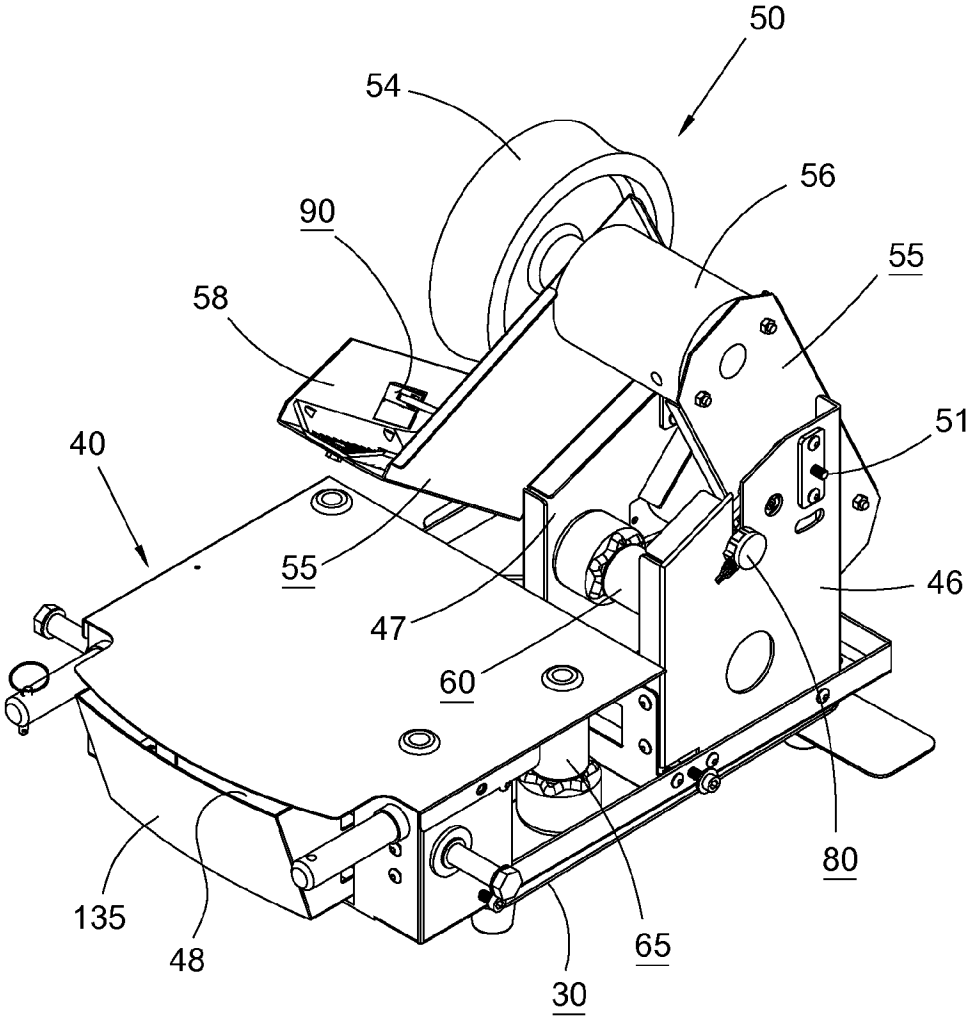
FIG. 6 is a rear perspective view of the preferred embodiment of the present invention.

Referring to FIGS. 1, 5 and 6, the ball-throwing machine 10 includes a base 30, a frame 40, a ball-throwing mechanism 50, two servomotors 60, 65, two linkages 70, 75, two angle sensors 80, 85, a detector 90 and a circuit unit.

Figure 7:
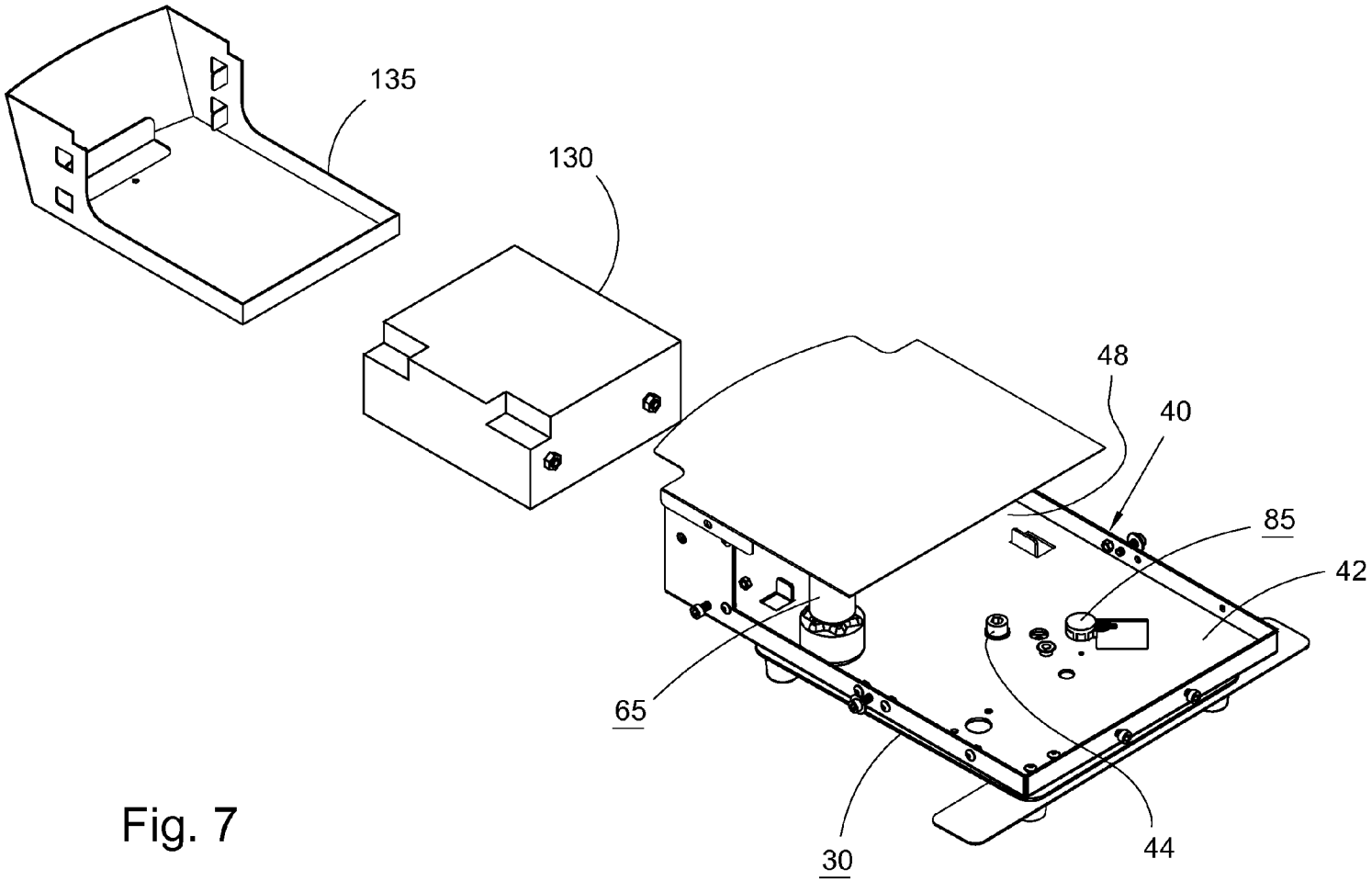
FIG. 7 is a perspective exploded view of the preferred embodiment of the present invention, showing the structures of the bottom board of the frame and the base of the present invention.
Figure 8:
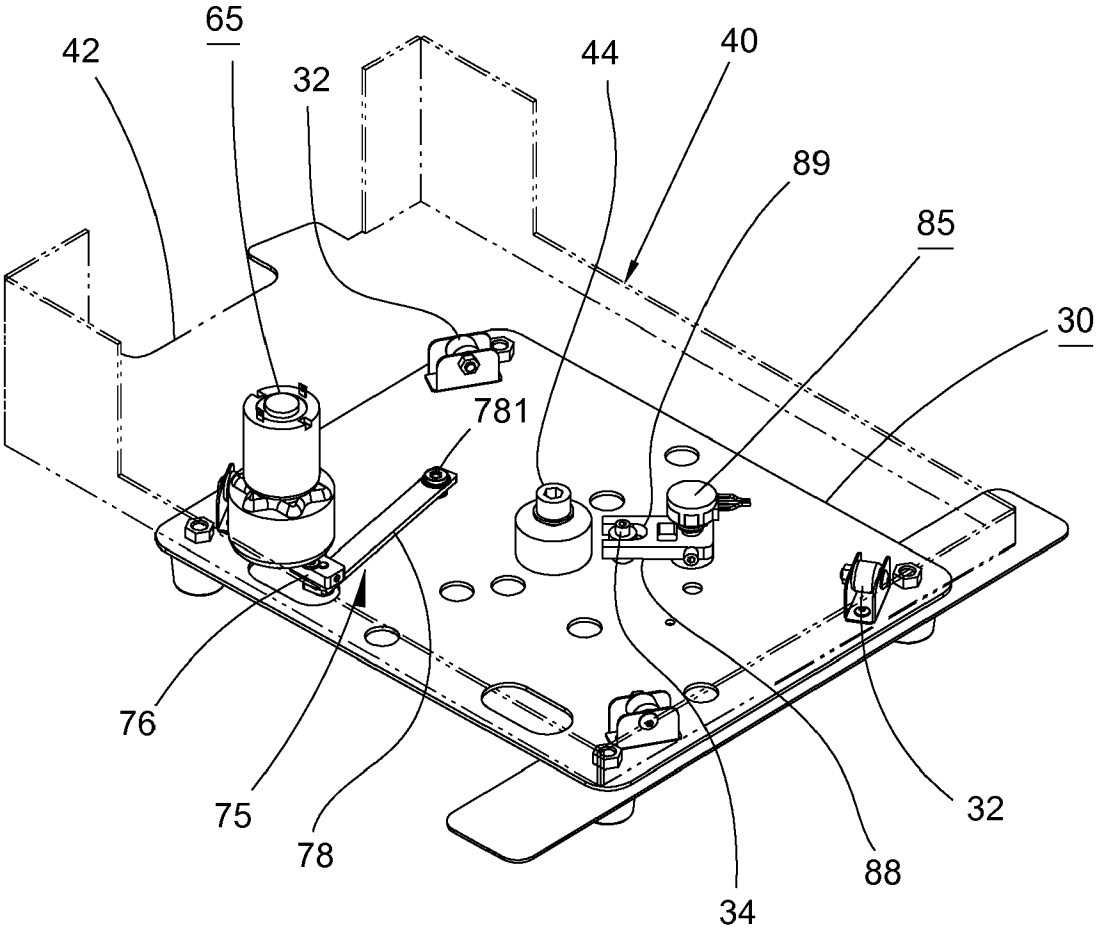
FIG. 8 is a view according to FIG. 7, showing the structure of the present invention under the bottom board of the frame.
Figure 9:
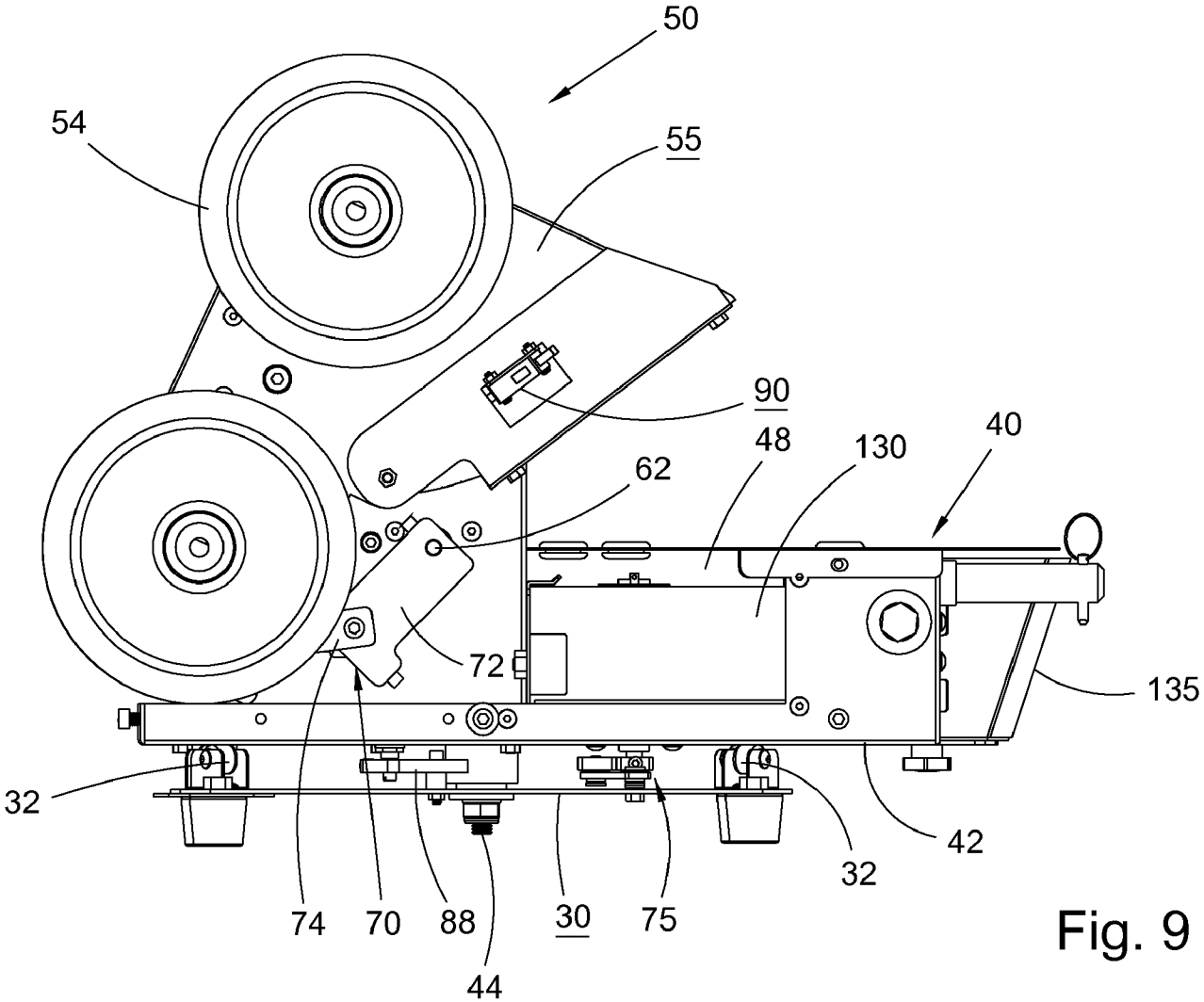
FIG. 9 is a right view according to FIG. 1.

Referring to FIGS. 7 and 8, the frame 40 has a bottom board 42 which is pivotally connected on the base 30 via a pivot shaft 44. The frame 40 is left and right rotatable. Four rollers 32 are mounted on a top face of the base 30 at intervals to contact with a bottom face of the bottom board 42 as shown in FIG. 9, whereby the frame can stably rotate without shaking. The frame further includes two upright boards 46, 47 standing on the bottom board 42 as shown in FIGS. 1 and 5.

Figure 3:
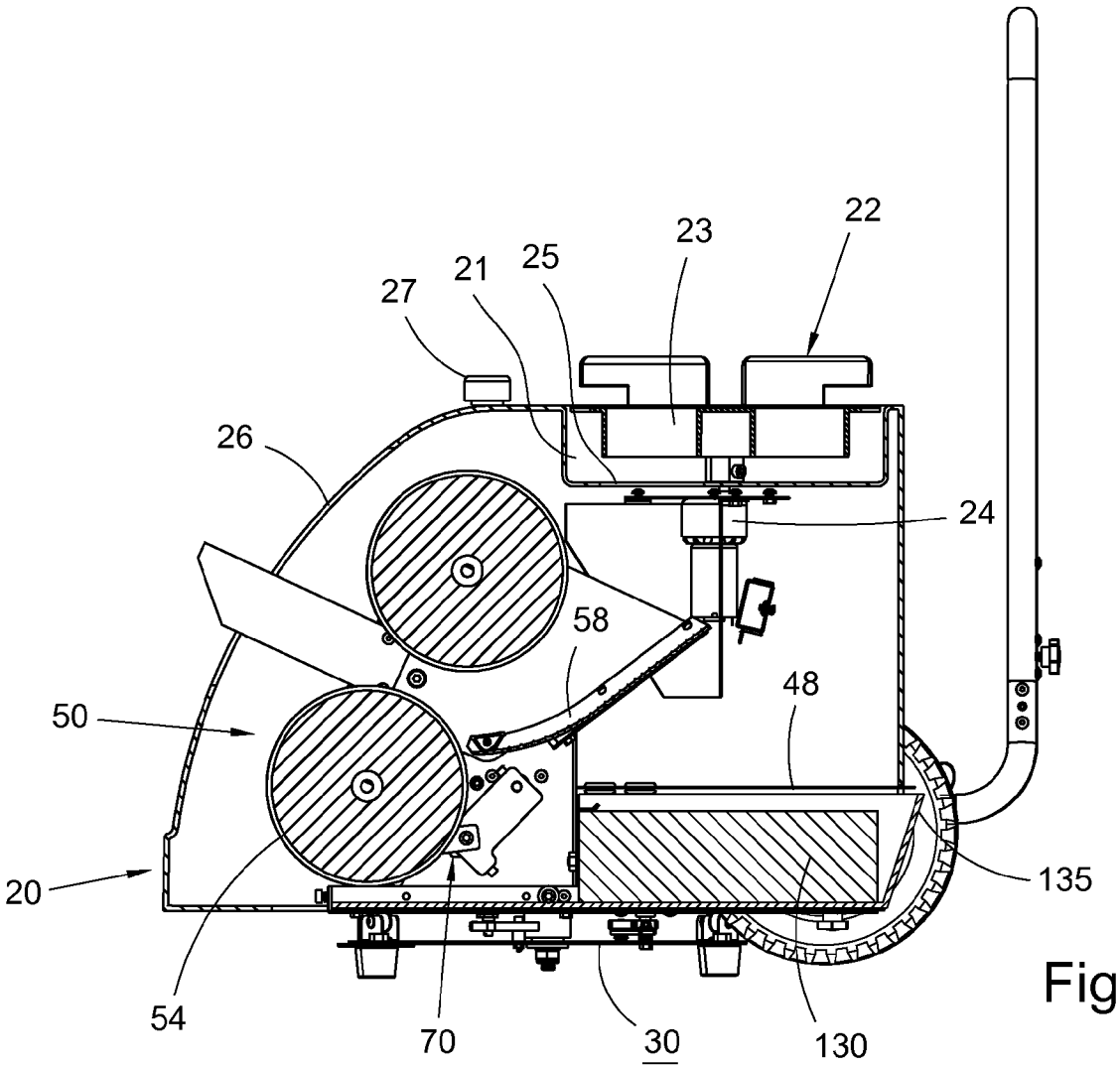
FIG. 3 is a longitudinal sectional view according to FIG. 2.

The ball-throwing mechanism 50 is pivotally connected with the two upright boards 46, 47 of the frame 40 via a pivot shaft 51 as shown in FIGS. 1 and 5. The ball-throwing mechanism 50 is up and down rotatable (vertically rotatable). The ball-throwing mechanism 50 includes two ball-throwing wheels 54. However, the ball-throwing mechanism 50 is not limited to such arrangement. In this embodiment, the two ball-throwing wheels 54 are pivotally connected with one side of a bracket 55. The bracket 55 is pivoted on the pivot shaft 51 to vertically rotate. Two motors 56 are mounted on the bracket 55 for driving the two ball-throwing wheels to rotate in reverse directions. A ball passage 58 is connected with the bracket 55 and positioned under the two ball-throwing wheels 54. A rear end of the ball passage 58 is positioned under the hole 25 of the housing 20 as shown in FIG. 3. A front end of the ball passage 58 is positioned between the two ball-throwing wheels 54. After a ball drops from the hole 25 of the housing 20, the ball reaches the rear end of the ball passage 58 and rolls forward along the inclined ball passage 58. When the ball contacts the ball-throwing wheels 54, the ball is driven and thrown forward by the ball-throwing wheels 54 and is ejected from the opening 26 of the housing.

Figure 10:
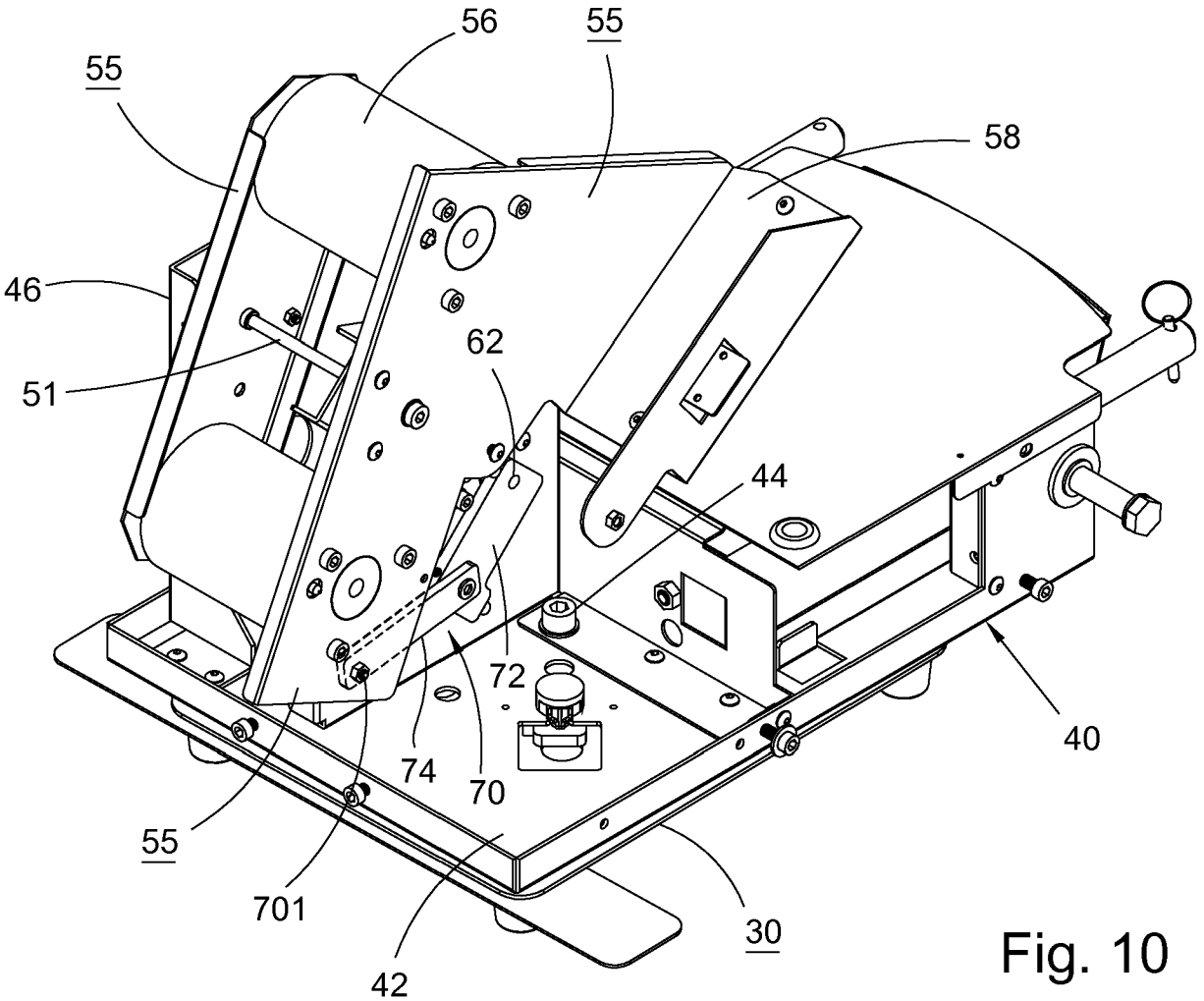
FIG. 10 is a perspective view according to FIG. 1, in which the ball-throwing wheels are removed.
Figure 11:
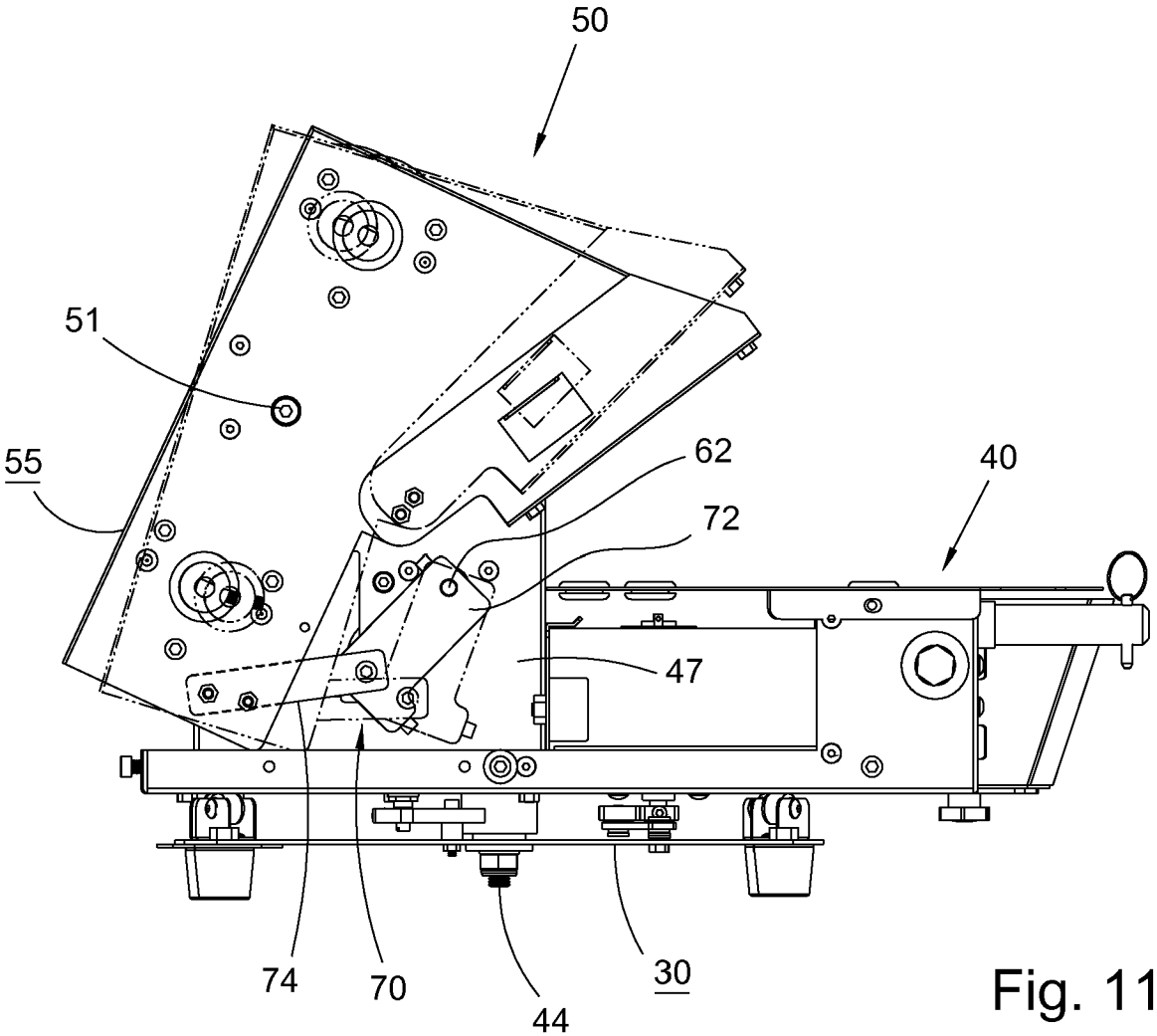
FIG. 11 is a side view according to FIG. 10.

Referring to FIG. 6, the first servomotor 60 is mounted on an upright board 47 of the frame 40. Referring to FIGS. 9 and 10, the first linkage 70 includes two links 72, 74 pivotally connected with each other. A free end of the link 72 is fixedly connected with a rotary shaft 62 of the servomotor 60, while a free end of the link 74 is pivotally connected with the bracket 55 via a screw 701. When the servomotor 60 rotates forward/backward, via the linkage 70, the ball-throwing mechanism 50 is driven to rotate up and down (vertically) so as to change ball-throwing angle as shown in FIG. 11. It should be noted that the first servomotor can be mounted on the bracket. One end of the first linkage can be connected with the motor, while the other end of the first linkage can be pivotally connected with an upright board of the frame. In this case, the first servomotor and the first linkage can also drive the ball-throwing mechanism 50 to rotate up and down.

Figure 12:
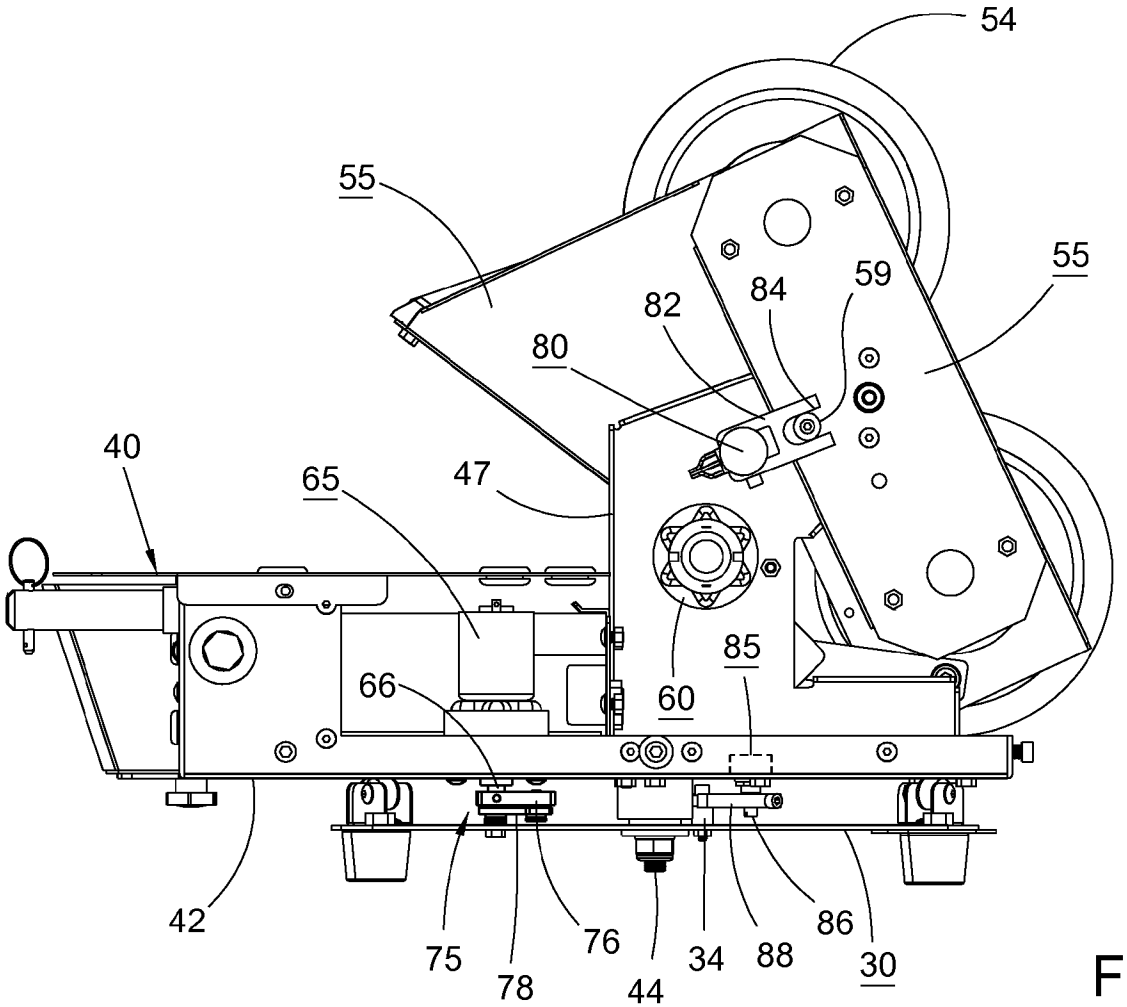
FIG. 12 is a left view according to FIG. 1, in which an upright board of the frame is removed to show the first angle sensor and related structures.

Referring to FIGS. 7, 8 and 12, the second servomotor 65 is mounted on the bottom board 42 of the frame. A rotary shaft 66 of the second servomotor 65 downward extends out of the bottom board. The second linkage 75 is mounted between the bottom board 42 and the base 30. The second linkage 75 includes two links 76, 78 pivotally connected with each other. A free end of the link 76 is fixedly connected with the rotary shaft 66 of the servomotor 65, while a free end of the link 78 is pivotally connected with the base 30 via a screw 781. When the servomotor 65 rotates forward/backward, via the second linkage 75, the frame 40 is driven to rotate left and right (horizontally) on the base. It should be noted that the second servomotor can be mounted on the base. One end of the second linkage can be connected with the motor, while the other end of the second linkage can be pivotally connected with the frame. In this case, the second servomotor and the second linkage can also drive the frame to rotate left and right.

Figure 13:
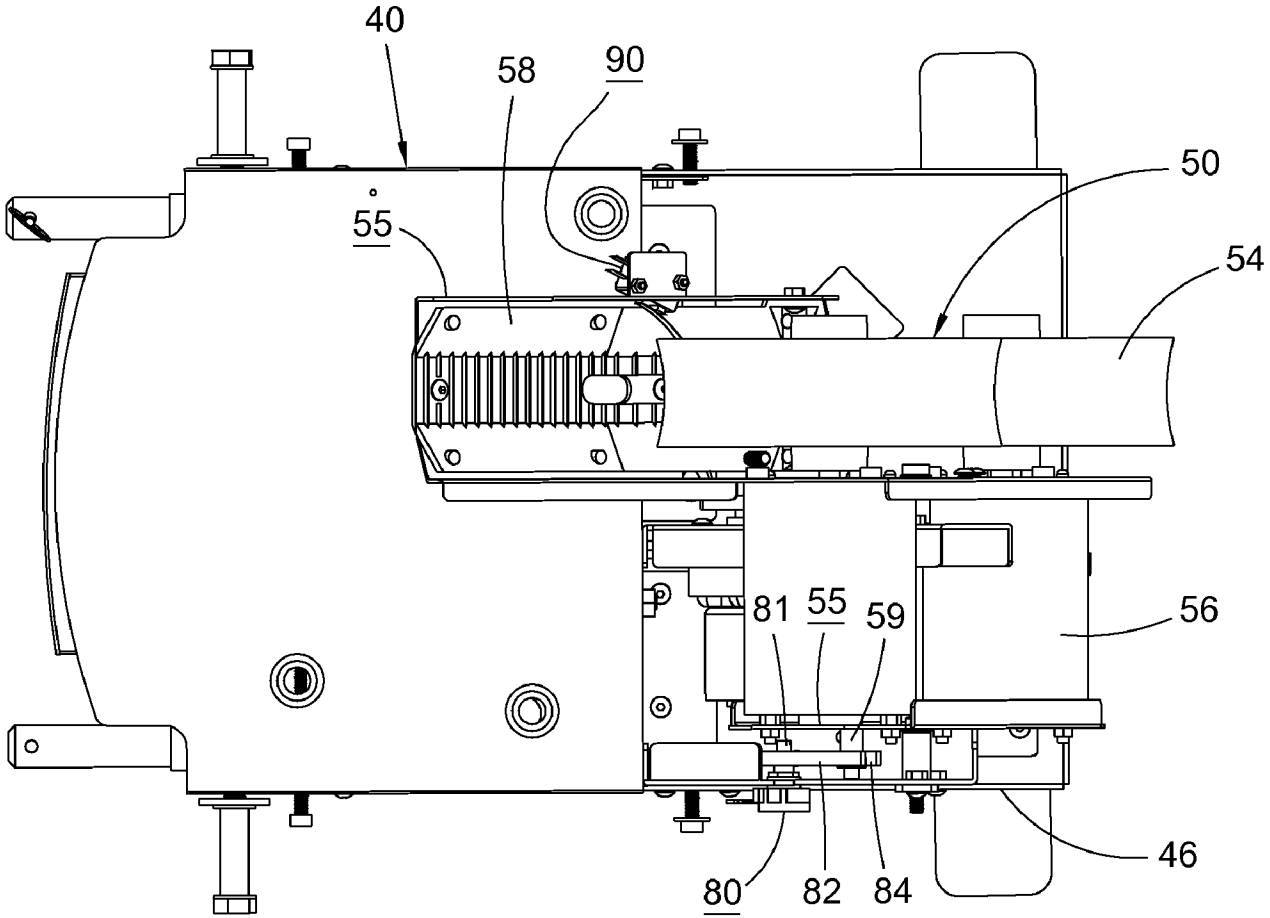
FIG. 13 is a top view according to FIG. 12.

Referring to FIGS. 12 and 13, the first angle sensor 80, which is a variable resistor in the embodiment, is mounted on an upright board 46 of the frame. One end of a link 82 is fixedly connected with a mandrel 81 of the angle sensor, while the other end of the link 82 is pivotally connected with the bracket 55 of the ball-throwing mechanism. In practice, the pivoted end of the link 82 is formed with a slot 84 in which a boss 59 fixed on the bracket is fitted. When the ball-throwing mechanism swings, via the link 82, the mandrel of the angle sensor 80 is driven and rotated, whereby the angle sensor can detect the rotational angle thereof. Alternatively, the angle sensor is mounted on the bracket. One end of the link 82 is connected with the angle sensor, while the other end of the link 82 is pivotally connected with the upright board of the frame.

Referring to FIGS. 8 and 12, the second angle sensor 85 is mounted on the bottom board 42 of the frame. One end of a link 88 is fixedly connected with a mandrel 86 of the second angle sensor 85, while the other end of the link 88 is pivotally connected with the base 30. In practice, the pivoted end of the link 88 is formed with a slot 89 in which a boss 34 fixed on the base is fitted. When the frame rotates horizontally, the angle sensor 85 can detect the rotational angle thereof. Similarly, alternatively, the angle sensor 85 can be mounted on the base. One end of the link 88 is connected with the angle sensor, while the other end of the link 88 is pivotally connected with bottom board.

Referring to FIGS. 1 and 6, the detector 90 is arranged on the ball passage 58 of the ball-throwing mechanism. In this embodiment, the detector 90 is a limit switch. However, this is not limited. For example, the detector 90 can be a photoelectric switch. When one ball passes through the ball passage, the detector 90 creates a detection signal.

Figure 4:
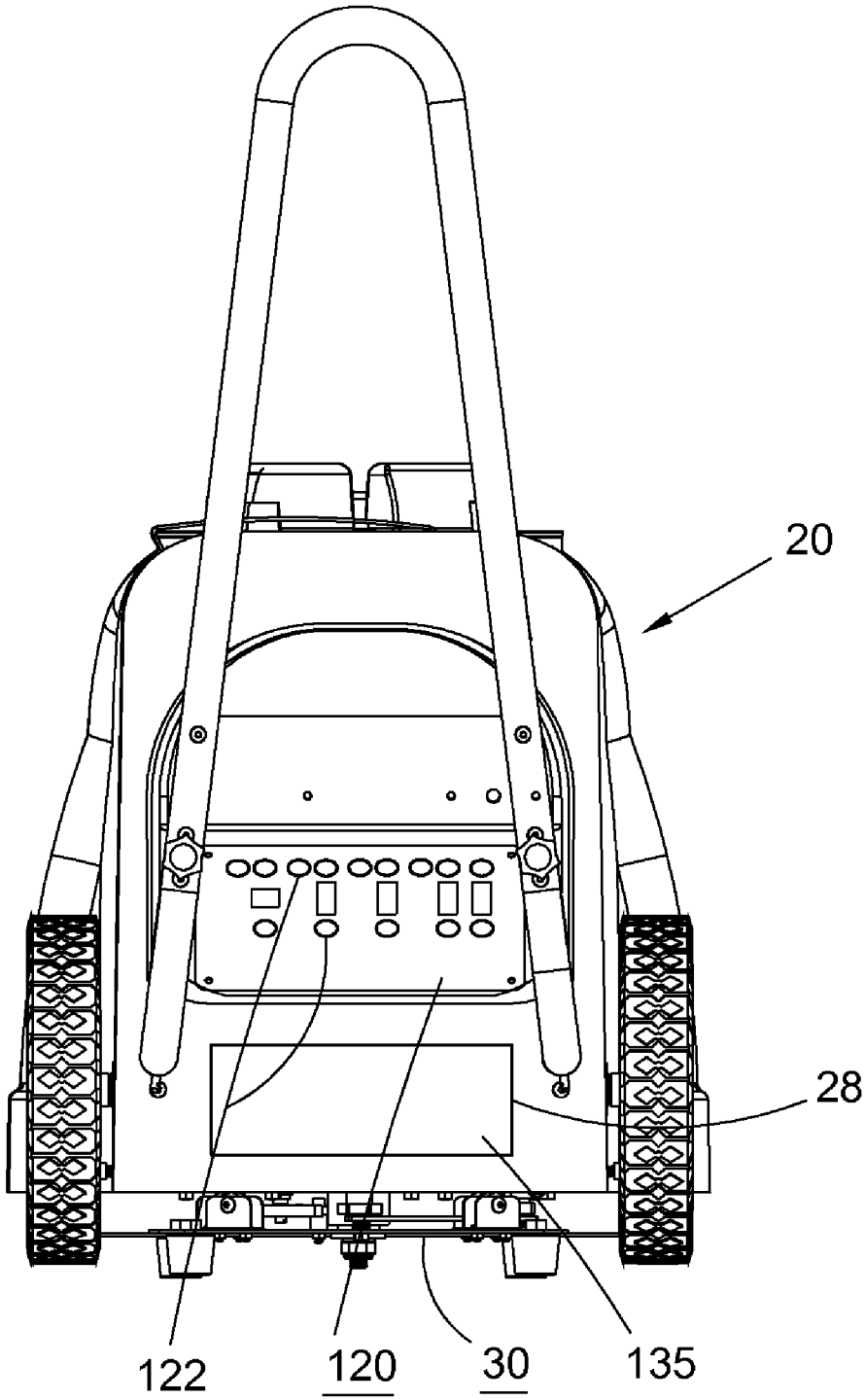
FIG. 4 is a rear view according to FIG. 2.
Figure 14:
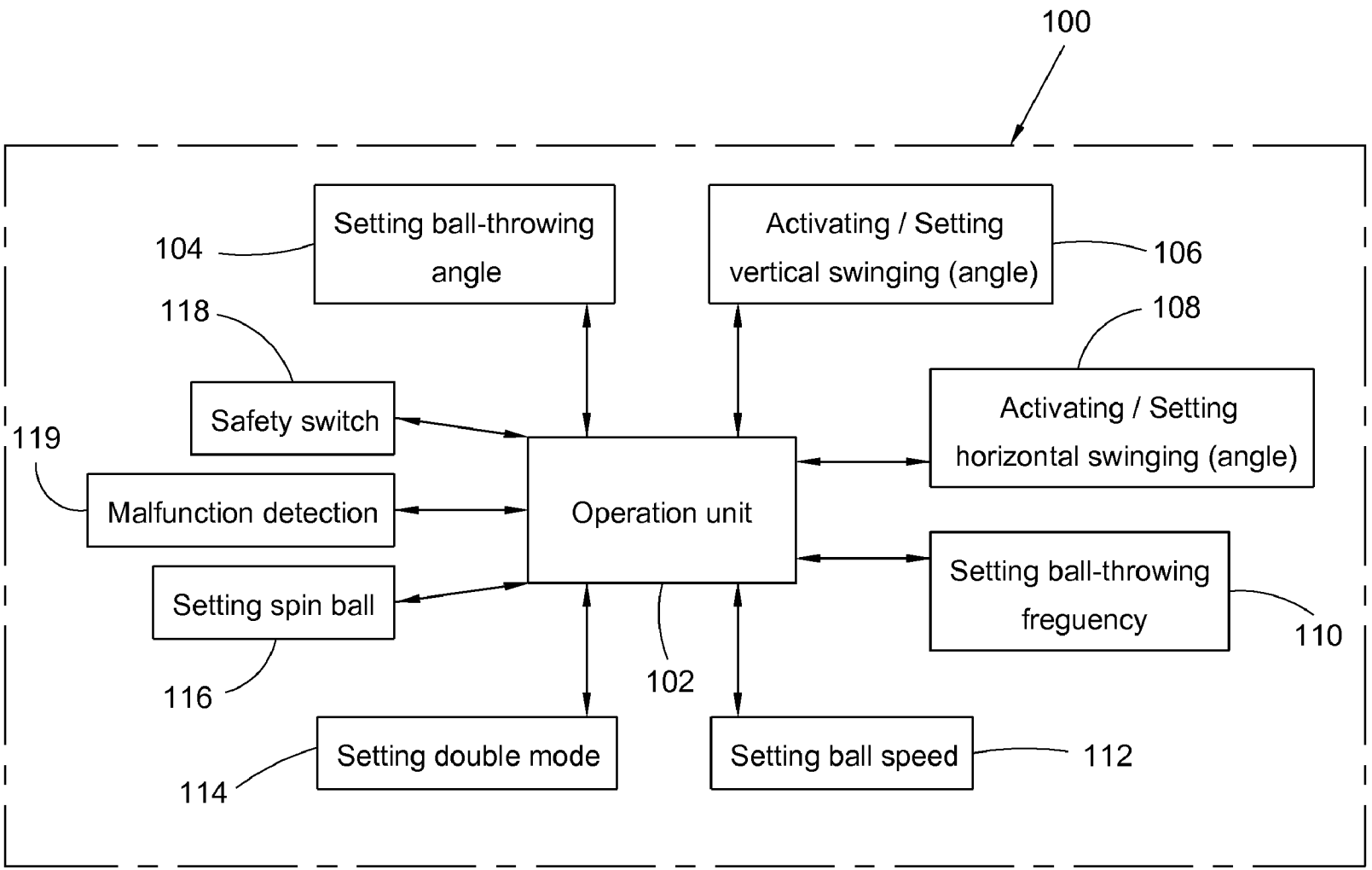
FIG. 14 is a block diagram of the circuit unit of the preferred embodiment of the present invention.

The circuit unit 100 has operation and setting functions as shown in FIG. 14. The circuit of the circuit unit is formed as a circuit board having an operation unit 102 for various setting functions. For example, with the operation unit 102, a user can set ball-throwing angle 104, vertical swing angle 106, horizontal swing angle 108, ball-throwing frequency 110, ball-throwing speed 112 and double mode 114. Referring to FIG. 4, a panel 120 is disposed on a back face of the housing 20. The panel 120 has several press keys 122 for executing the setting functions of the circuit unit. The ball-throwing mechanism 50, the servomotor 60, 65, the angle sensors 80, 85 and the detector 90 all are electrically connected with the circuit unit 100 for performing electromechanical operations.

The present invention can be powered by AC power or batteries. The panel 120 has a switch for switching the power between AC power and DC power. Referring to FIGS. 6 and 7, the rear end of the frame 40 is formed with a space 48 in which a battery 130 is mounted. In this embodiment, the battery 130 is placed in a battery rack 135 which is slid into the space 48 from the rear end of the frame as shown in FIG. 3. When charging the battery, the battery rack 135 is drawn out from an opening 28 of the back face of the housing 20 as shown in FIG. 4. After charged, the battery rack is again moved into the space 48 from the opening 28. Accordingly, the battery can be easily taken out and placed in without disassembling the housing.

The ball-throwing machine 10 is applicable to tennis, squash or the like. After powered on, the ball-throwing machine 10 can be used. When setting the ball-throwing angle 104, the first servomotor 60 via the first linkage 70 drives the ball-throwing mechanism 50 to swing vertically. The first angle sensor 80 emits a signal for the circuit unit 100 to judge the rotational angle of the bracket 55 of the ball-throwing mechanism 50. After the ball-throwing mechanism 50 swings to the set angle, the circuit unit 100 stops the first servomotor 60 from operating. At this time, the ball-throwing mechanism 50 is located at the angle for throwing the ball by this angle.

The ball-throwing mechanism 50 of the present invention can swing up and down within a range of several decades of degrees. When setting vertical swinging angle 106, the swinging range of the ball-throwing mechanism 50 can be controlled. For example, the swinging range can be set 10 degrees. In addition, the upper limit angle (for example, elevation 45 degrees) and lower limit angle (for example, elevation 35 degrees) of the swinging range can be also set. When the rotary shaft of the first servomotor 60 clockwise rotates, via the first linkage 70, the bracket 55 of the ball-throwing mechanism 50 is driven to swing upward. When reaching the upper limit angle, the first angle sensor 80 will detect this and the circuit unit 100 will stop the motor 60 from clockwise rotating and make the motor 60 counterclockwise rotate. At this time, the ball-throwing mechanism 50 swings downward. After reaching the lower limit angle of the swinging range, the first angle sensor 80 detects this and the circuit unit drives the motor 60 to clockwise rotate, whereby the ball-throwing mechanism 50 again swings upward. Accordingly, the ball-throwing mechanism 50 can swing up and down within the set angle range as shown in FIG. 11 to vary the destination of thrown ball.

The vertical swinging angle of the ball-throwing mechanism 50 can be set in cooperation with the aforesaid ball-throwing angle. That is, after setting the ball-throwing angle 104, the up and down swinging range of the ball-throwing mechanism 50 can be set from the ball-throwing angle plug several degrees to the ball-throwing angle minus several degrees.

When setting horizontal swinging angle 108, the frame 40 can horizontally swing back and forth within a set angle range. For example, the frame 40 is set to horizontally swing between leftward 8 degrees and rightward 8 degrees. When the rotary shaft of the second servomotor 65 rotates in one direction, the second linkage 75 is driven to drive the frame to leftward swing. When the frame swings, the second angle sensor 85 detects the swinging angle for the circuit unit 100 to judge. After the frame reaches the left limit angle of the horizontal swinging range, the circuit unit 100 stops the motor 65 from rotating and makes the rotary shaft thereof rotate in the other direction. At this time, the frame 40 swings rightward. When reaching the right limit angle, the second angle sensor 85 will detect this and the circuit unit will make the motor 65 drive the frame to again swing leftward. Accordingly, the ball-throwing machine 10 can horizontally swing back and forth to throw the ball to a left side or right side of the field.

According to the above arrangement, a user can set both vertical and horizontal swinging ranges of the ball-throwing machine to vary the destination of the ball.

In practice, the second angle sensor 85 is omissible. When the second motor 65 revolves by one circle as a common motor, the second linkage 75 serves to drive the frame to horizontally back and forth swing. Without the second angle sensor 85, the function of setting horizontal swinging angle is unavailable. The frame is simply swung back and forth via the movement of the linkage. On the other hand, with the second sensor 85, in case of abnormality, although it is impossible to set the horizontal swinging angle, the ball-throwing machine can still swing horizontally.

By means of setting the ball-throwing frequency, the interval between the throws is adjustable. By means of setting the ball-throwing speed 112, the rotational speed of the ball-throwing wheels 54 is adjustable to control the speed of the thrown ball.

When setting double mode 114, the detector 90 is activated in cooperation with the horizontal swing of the ball-throwing machine. When the frame swings rightward, the ball-throwing mechanism 50 ejects a ball. The detector 90 creates a ball-throwing signal. The operation unit 102 detects the signal to make the frame 40 swing leftward and ejects another ball to left side of the field. After the ball is ejected to the left side of the field. The detector 90 further transmits a ball-throwing signal for the operation unit to drive the frame to swing rightward and another ball is ejected to the right side. Accordingly, each time a ball is ejected, the ball-throwing machine 10 horizontally swings to the other side to eject the next ball to the other side of the field.

When setting spin effect 116, the two ball-throwing wheels rotate at different speeds. Accordingly, a topspin ball or a backspin ball is achieved. The above functions can be co-used.

The circuit unit 100 of the present invention is further equipped with a safety switch 118 (on the panel 120). When setting the functions of the ball-throwing machine, a user can press the safety switch to stop the rotary tray 22 from operating without cutting off the main power of the ball-throwing machine. Under such circumstance, no ball will be ejected. This on one hand saves power and on the other hand provides a safety effect to protect a person from being incautiously hit by the ball when setting functions. After the setting is completed, the operation of the ball-feeding mechanism is recovered by re-pressing the safety switch. Similarly, it can be designed that the ball-throwing mechanism is stopped from operating without cutting off the main power when the safety switch is pressed.

The circuit unit 100 is further designed with a malfunction detection function 119 for detecting whether the respective parts of the ball-throwing machine work normally. In case that some part works abnormally, a liquid crystal display of the panel 120 will show the code of the part (each part is given a code or a serial number). Accordingly, a user can quickly find out which part malfunctions without checking one by one.

According to the above arrangement, the first motor and the first linkage of the present invention serve to move the ball-throwing mechanism to a necessary ball-throwing angle. The same motor and the same linkage can drive the ball-throwing mechanism to continuously swing up and down without using another motor.

The second motor and the second linkage of the present invention serve to drive the ball-throwing machine to horizontally swing back and forth.

The angle sensors of the present invention serve to detect the vertical and horizontal swinging angles of the ball-throwing machine so as to set the swinging angle of the ball-throwing machine. The battery of the ball-throwing machine can be easily taken out and placed in. In addition, the safety design of the present invention ensures safety of surrounding persons. Also, the ball-throwing machine of the present invention has malfunction detection function.

The above embodiment is only used to illustrate the present invention, not intended to limit the scope thereof. Many modifications of the above embodiments can be made without departing from the spirit of the present invention.

What is claimed is:

1. A ball-throwing machine comprising:

a frame;

a ball-throwing mechanism pivotally connected with the frame and up and down rotatable, whereby a ball fed into the ball-throwing mechanism being ejected from the mechanism;

a first servomotor and a first linkage mounted between the frame and the ball-throwing mechanism, the first servomotor being clockwise and counterclockwise rotatable, whereby via the first linkage, the first servomotor driving the ball-throwing mechanism to swing up and down;

a first angle sensor mounted between the frame and the ball-throwing mechanism for detecting the swinging angle of the ball-throwing mechanism;

a circuit unit serving to receive a signal from the first angle sensor and control the operation of the first servomotor for moving the ball-throwing mechanism to a ball-throwing angle and making the ball-throwing mechanism swing up and down;

a base;

the frame having a bottom board pivotally connected on the base, whereby the frame is horizontally rotatable;

a second servomotor and a second linkage mounted between the base and the frame, the second servomotor being clockwise and counterclockwise rotatable, whereby via the second linkage, the second servomotor driving the frame to swing horizontally;

a second angle sensor mounted between the base and the frame for detecting the swinging angle of the frame;

the circuit unit serving to receive a signal from the second angle sensor and control the operation of the second servomotor for making the frame swing left and right;

a detector mounted on the ball-throwing mechanism, whereby when the ball-throwing mechanism ejects a ball, the detector creates a signal, the circuit unit receiving the signal to drive the frame to swing horizontally.

2. The ball-throwing machine as claimed in claim 1, wherein the ball-throwing mechanism has a ball passage where a ball is fed into; the detector is arranged in the ball passage.

3. The ball-throwing machine as claimed in claim 1, wherein the ball-throwing mechanism includes a bracket and two ball-throwing wheels mounted on the bracket at a certain interval; a ball passage being mounted on the bracket; a front end of the ball passage being positioned between the two ball-throwing wheels; the bracket being pivotally connected with the frame and up and down rotatable; two motors being mounted in the bracket for respectively driving the two ball-throwing wheels to rotate.

4. The ball-throwing machine as claimed in claim 1, wherein the first angle sensor is disposed on the frame and has a mandrel; one end of a link being fixedly connected with the mandrel of the first angle sensor, while the other end of the link being pivotally connected with the ball-throwing mechanism.

5. The ball-throwing machine as claimed in claim 1, wherein the second angle sensor is disposed on the frame and has a downward extending mandrel; one end of a link being fixedly connected with the mandrel of the second angle sensor, while the other end of the link being pivotally connected with the base.

6. The ball-throwing machine as claimed in claim 1, wherein the first servomotor is fixedly mounted on the frame; one end of the first linkage being connected with a rotary shaft of the first servomotor, while the other end of the first linkage being pivotally connected with the ball-throwing mechanism.

7. The ball-throwing machine as claimed in claim 1, wherein the second servomotor is mounted on the frame and has a rotary shaft directed downward; one end of the second linkage being connected with the rotary shaft of the second servomotor, while the other end of the second linkage being pivotally connected with the base.

8. The ball-throwing machine as claimed in claim 1, further comprising:

a base; the frame having a bottom board pivotally connected on the base, whereby the frame is horizontally rotatable; and a second motor and a second linkage mounted between the base and the frame, the second motor serving to via the second linkage drive the frame to swing horizontally.

9. The ball-throwing machine as claimed in claim 1, wherein the circuit unit includes functions of setting ball-throwing angle and setting angle range of vertical swing.

10. The ball-throwing machine as claimed in claim 1, wherein the circuit unit includes functions of setting double mode, whereby under the double mode, each time after a ball is ejected by the ball-throwing mechanism, the circuit unit drives the frame to horizontally swing from the home position to the other side.

11. The ball-throwing machine as claimed in claim 1, the circuit unit is equipped with a safety switch, whereby when the safety switch is pressed, the ball-throwing mechanism is stopped from operating without cutting off main power of the ball-throwing machine.

12. The ball-throwing machine as claimed in claim 1, further comprises a ball-feeding mechanism for feeding balls into the ball-throwing mechanism; the circuit unit is equipped with a safety switch, whereby when the safety switch is pressed, the ball-feeding mechanism is stopped from operating without cutting off main power of the ball-throwing machine.

13. The ball-throwing machine as claimed in claim 1, wherein the circuit unit further has a malfunction detection function for detecting whether the respective parts of the ball-throwing machine work normally, whereby in case of abnormality, the abnormal part is shown.

14. The ball-throwing machine as claimed in claim 13, further comprises a panel having several press keys and at least one display for showing the abnormal part.

15. The ball-throwing machine as claimed in claim 1, wherein a rear end of the frame is formed with a space in which a battery rack is drawably mounted; a battery is placed in the battery rack.

16. The ball-throwing machine as claimed in claim 15, further comprises a hosing in which the ball-throwing machine is enclosed; a back face of the housing has an opening aligned with a rear end of the space.

17. The ball-throwing machine as claimed in claim 1, wherein the angle sensor is a variable resistor.

18. A ball-throwing machine comprising:

a frame;

a ball-throwing mechanism pivotally connected with the frame and up and down rotatable, whereby a ball fed into the ball-throwing mechanism being ejected from the mechanism;

a first servomotor and a first linkage mounted between the frame and the ball-throwing mechanism, the first servomotor being clockwise and counterclockwise rotatable, whereby via the first linkage, the first servomotor driving the ball-throwing mechanism to swing up and down;

a first angle sensor mounted between the frame and the ball-throwing mechanism for detecting the swinging angle of the ball-throwing mechanism;

a circuit unit serving to receive a signal from the first angle sensor and control the operation of the first servomotor for moving the ball-throwing mechanism to a ball-throwing angle and making the ball-throwing mechanism swing up and down; and the first angle sensor is disposed on the frame and has a mandrel; one end of a link being fixedly connected with the mandrel of the first angle sensor, while the other end of the link being pivotally connected with the ball-throwing mechanism.

19. A ball-throwing machine comprising:

a frame;

a ball-throwing mechanism pivotally connected with the frame and up and down rotatable, whereby a ball fed into the ball-throwing mechanism being ejected from the mechanism;

a first servomotor and a first linkage mounted between the frame and the ball-throwing mechanism, the first servomotor being clockwise and counterclockwise rotatable, whereby via the first linkage, the first servomotor driving the ball-throwing mechanism to swing up and down;

a first angle sensor mounted between the frame and the ball-throwing mechanism for detecting the swinging angle of the ball-throwing mechanism; and a circuit unit serving to receive a signal from the first angle sensor and control the operation of the first servomotor for moving the ball-throwing mechanism to a ball-throwing angle and making the ball-throwing mechanism swing up and down;

a base; the frame having a bottom board pivotally connected on the base, whereby the frame is horizontally rotatable;

a second servomotor and a second linkage mounted between the base and the frame, the second servomotor being clockwise and counterclockwise rotatable, whereby via the second linkage, the second servomotor driving the frame to swing horizontally;

a second angle sensor mounted between the base and the frame for detecting the swinging angle of the frame;

the circuit unit serving to receive a signal from the second angle sensor and control the operation of the second servomotor for making the frame swing left and right; and the second angle sensor is disposed on the frame and has a downward extending mandrel; one end of a link being fixedly connected with the mandrel of the second angle sensor, while the other end of the link being pivotally connected with the base.

20. The ball-throwing machine as claimed in claim 19 comprises:

the first angle sensor is disposed on the frame and has a mandrel; and one end of a link being fixedly connected with the mandrel of the first angle sensor, while the other end of the link being pivotally connected with the ball-throwing mechanism.

* * * * *